United States Patent [19]

Schibbye et al.

[11] Patent Number: 4,498,849

[45] Date of Patent: Feb. 12, 1985

[54] VALVE ARRANGEMENT FOR CAPACITY CONTROL OF SCREW COMPRESSORS

[75] Inventors: (Lars) Lauritz B. Schibbye, Saltsjö-Dufnäs; Rolf A. Englund, Spånga, both of Sweden

[73] Assignee: Sullair Technology AB, Stockholm, Sweden

[21] Appl. No.: 532,296

[22] Filed: Sep. 14, 1983

Related U.S. Application Data

[63] Continuation-in-part of Ser. No. 260,056, May 4, 1981, abandoned.

[30] Foreign Application Priority Data

Jun. 2, 1980 [SE] Sweden ..... 8004091

[51] Int. Cl.[3] ..... F04C 18/16

[52] U.S. Cl. ..... 417/299; 417/310; 417/440

[58] Field of Search ..... 417/299, 310, 440; 418/201

[56] References Cited

U.S. PATENT DOCUMENTS

| | | | |
|---|---|---|---|
| 1,481,358 | 1/1924 | Dwyer | 417/440 |
| 3,045,447 | 7/1962 | Wagenius . | |
| 3,088,658 | 5/1963 | Wagenius . | |
| 3,088,659 | 5/1963 | Nilsson et al. . | |
| 3,108,739 | 10/1963 | Nilsson et al. . | |
| 3,108,740 | 10/1963 | Schibbye . | |
| 3,314,597 | 4/1967 | Schibbye . | |
| 3,432,089 | 3/1969 | Schibbye . | |
| 4,042,310 | 8/1977 | Schibbye et al. . | |

*Primary Examiner*—Richard E. Gluck

*Attorney, Agent, or Firm*—Wood, Dalton, Phillips, Mason & Rowe

[57] ABSTRACT

The invention relates to a valve arrangement for capacity control of an oil-injected screw compressor. One or more piston valves are arranged one after the other in the axial direction of the rotors at the portion of the rotor barrels where the internal compression phase occurs. The compressor control valves are actuated by the discharge pressure, which in their turn open or close the piston valves. When the piston valves are open, a portion of the gas in the compression space is discharged to a bleed off passageway and it flows back to the inlet port of the compressor so that substantially no compression work is spent on this portion of the gas.

9 Claims, 4 Drawing Figures

VALVE ARRANGEMENT FOR CAPACITY CONTROL OF SCREW COMPRESSORS

This application is a continuation-in-part of application Ser. No. 260,056, filed May 4, 1981, now abandoned.

DESCRIPTION

Background of the Invention

This invention relates to a valve arrangement for an oil-injected screw compressor of the kind comprising a housing, which includes a compression space consisting of two rotor barrels defined by two intersecting bores, and having a low-pressure opening at one end and a high-pressure opening at the other end, and two intermeshing screw rotors mounted rotationally in the rotor barrels, which valve arrangement is adapted to be connected to at least one of the cylindric rotor bores. The valve arrangement is intended to render it possible to control the capacity of the compressor operating at a constant number of revolutions.

Several solutions for establishing capacity control of screw compressors operating at constant speed are previously known and applied in practice since a number of years.

One of these solutions utilizing a conventional slide valve is disclosed, for example, in the U.S. Pat. Nos. 3,045,447; 3,088,659; 3,314,597 and 3,432,089. This valve type has the characterizing feature that it constitutes a portion of the barrels for the screw rotors and, besides, a portion of the radial discharge port. The advantages of these valves are continuous capacity control, a wide control range and the possibility that at a constant working pressure ratio in the compressor a relatively constant built-in pressure ratio within the greater part of the control range can be brought about by means of a suitable dimensioning of the axial discharge port. This relatively constant relation between the working pressure ratio and the built in pressure ratio within the part load range is important for keeping the good efficiency at low loads. The disadvantage is mainly that this slide valve type is very expensive to manufacture, because close tolerances and accurate centerings are required and that the actuating system, which normally is hydraulic, is also fairly expensive and complicated. In spite of these disadvantages, this valve type has been applied commercially for screw compressors for many years, primarily in the fields of refrigeration and air conditioning.

Another solution utilizing rotary or piston valves is disclosed, for example, in the U.S. Pat. Nos. 3,088,658 and 4,042,310. It is a characteristic of these valve types that their cylindric valve barrels do not constitute a portion in common with the rotor barrels, but are in communication therewith by slots through which gas is bled off at part load. This valve arrangement has the advantage of being less expensive to manufacture than the above described conventional slide valve type. Its disadvantages are that the capacity control is not as continuous as what is obtained with the slide valve arrangement, that the built-in pressure ratio drops with decreasing load, and that the actuating system for the valve is complicated and expensive. Leakage, moreover, is obtained across the slots along the rotor bores, especially at higher part loads and at full load, which seriously deteriorates the efficiency (at full load up to about 10% for a single-stage compressor). These valve types, too, have been utilized commercially for screw compressors, but not to the same extent as the aforesaid slide valve type.

A further solution is the utilization of slide or lift valves, which are axially or radially movable in the inlet or discharge end plane of the compressor. See, for example, the U.S. Pat. Nos. 3,108,739 and 3,108,740. For various reasons none of these different arrangements has proved applicable in practice and has therefore not been used commercially.

SUMMARY OF THE INVENTION

The object of the present invention is to provide a considerably less expensive capacity control arrangement than those heretofore used or proposed for screw compressors and thereby not only of the valve system itself but also of the actuating means. A further important object is to avoid the detrimental efficiency losses due to gas leakage which especially are involved with the aforesaid rotary or piston valves at higher loads and particularly at full load. The control arrangement according to the invention is not intended to give a continuous control of the compressor capacity, but a step control obtained due to the fact that the valves operate only in fully closed or fully open positions.

The said new control arrangement according to the present invention is defined by the characterizing features given in the attached claims.

The manner in which the invention is carried into effect and its more detailed nature and advantages may best be understood from a consideration of the ensuing portion of this specification, taken in conjunction with the accompanying drawings, in which suitable forms of apparatus are described by way of example.

DESCRIPTION OF THE PREFERRED EMBODIMENT

Figure 1:
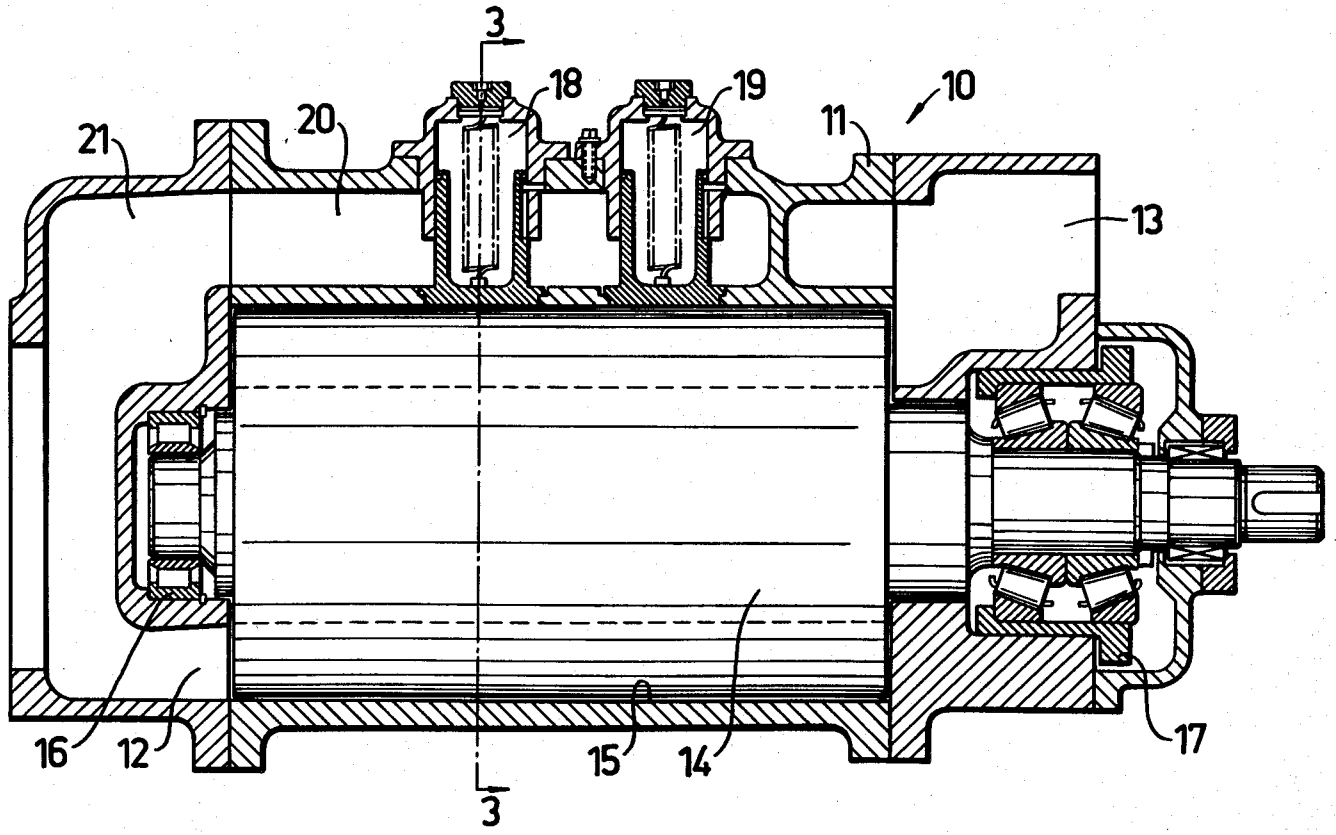
FIG. 1 is a schematic cross-section of a screw compressor provided with a valve arrangement according to the invention, the section laid through the center of the male rotor.

The screw compressor 10 comprises a housing 11 with a low-pressure inlet port 12 and a high-pressure discharge port 13. The housing includes two intersecting bores forming two rotor barrels in which two meshing rotors are mounted. In FIG. 1 one rotor, the male rotor 14, with its bore 15 is shown. Said male rotor 14 is supported at its two ends in the housing 11 by means of roller bearings 16,17.

At the highest located line of the bore 15 of the male rotor in which area the internal compression takes place, two identical valves 18,19 located axially one after the other are provided. Above this upper portion of the bore 15 a bleed off passageway 20 common for both valves 18,19 is located, to which the valves 18,19 can open. This passageway 20 then continues with an end wall passageway 21 extending back to the inlet port 12.

Figure 2:
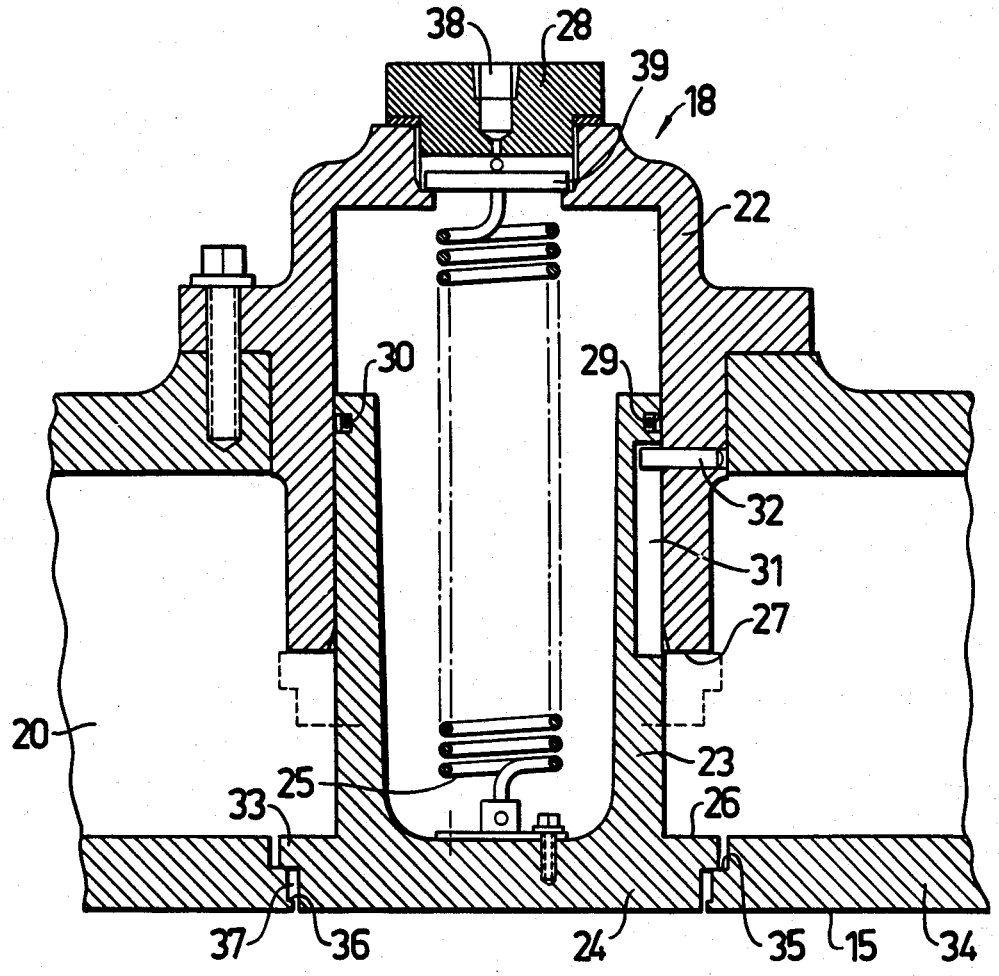
FIG. 2 is a section on an enlarged scale through a valve according to the invention.
Figure 3:
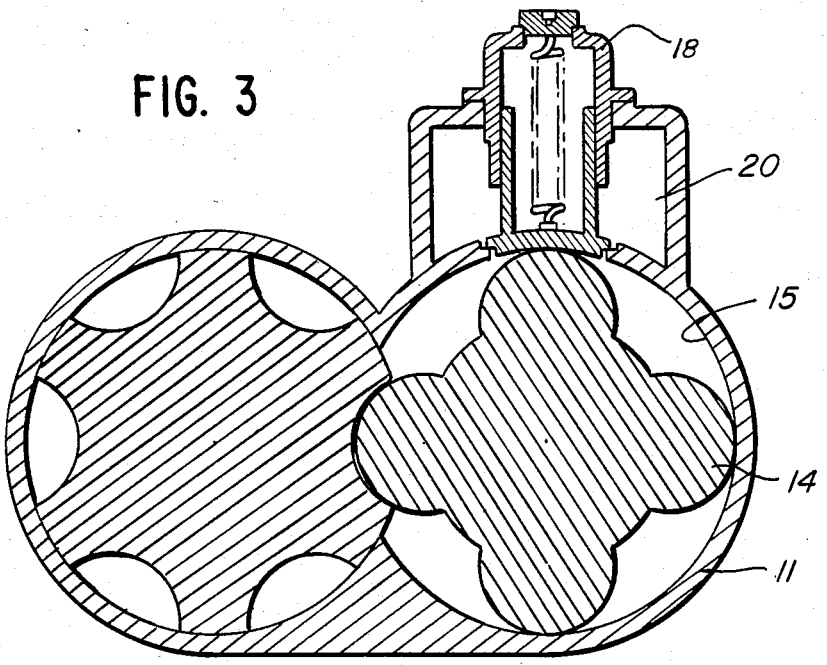
FIG. 3 is a schematic cross-section through the compressor along the line 3—3 in FIG. 1.
Figure 4:
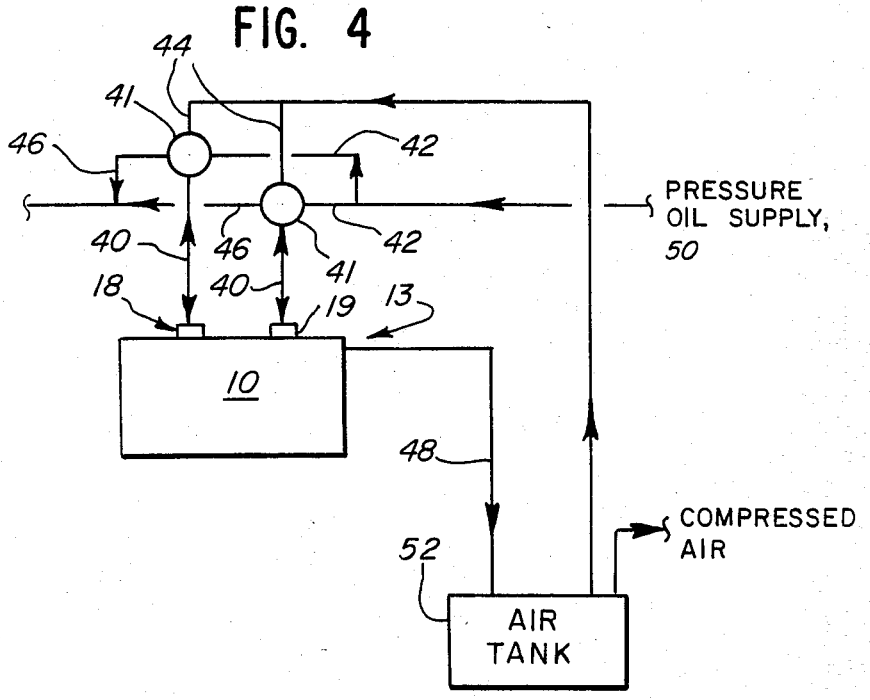
FIG. 4 is a diagrammatic illustration of the manner in which the valve arrangement is actuated.

The valve 18 substantially is built up of a valve housing 22, which is attached on the outside of the bleed off passageway 20 and is inserted therein, and in which a cylindric valve piston 23 closed at one end is slidably movable. The closed end of the valve piston 23 constitutes the valve disk 24 which also constitutes a portion of the bore 15. The valve housing 22 and valve piston 23 are internally provided with a tension spring 25, which is connected between the closed end of the valve disk 24 of the valve piston 23 and the upper portion of the valve housing 22 by means of a pin 39, in such a manner, that it tends to lift the valve disk 24 until an annular shoulder 26 projecting on the upper surface of the valve disk 24 abuts the lower annular end 27 of the valve housing 22 projecting into the bleed off passageway 20. This position is indicated by dashed lines in FIG. 2. The valve housing 22 is provided at the top with a plug 28, in which a connection 38 for supply of a medium, preferably oil from an oil supply 50, for controlling the position of the valve piston 23 is located. The connection 38 is connected to a simple three-way valve 41 (FIG. 4), through which the oil via line 42, having a pressure substantially equal to the discharge pressure of the compressor, can be supplied through line 40 to the valve piston 23 in order to move the valve disk 24 to its closed position and thereby to interrupt the connection between the rotor bore 15 and the bleed off passageway 20. The three-way valve 41 is a commercially available three-way valve of the general type manufactured by Fluid Controls Inc., 8341 Tyler Blvd., Mentor, Ohio. The three-way valve 41 is controlled in a suitable way automatically by the pressure in a compressed air tank 52, which tank is supplied with compressed air from the compressor via line 48, with the compressed air flowing from the compressed air tank to the valve 41 through line 44. For effecting sealing between the inner surface of the valve housing 22 and the outer surface of the valve piston 23, in said outer surface a circular groove 29 is located, in which a sealing ring 30 is provided. An axial groove 31 also is located in the outer surface of the valve piston 23, into which groove a stud 32 mounted in the valve housing 22 projects in order to prevent the valve piston 23 from rotating in relation to the valve housing 22.

The valve disk 24 is formed with a projecting flange 33, which sealingly abuts a shoulder 35 located in the wall 34 of the part in the rotor barrel 15. A further shoulder 36 is located in the part in the wall 34, close to the rotor bore 15, so that a recess 37 is formed between the valve disk 24 and wall 34. Through this recess 37 a connection between the compression space and the bleed off passageway 20 is rapidly obtained when the valve piston 23 commences being lifted.

When the compressor operates at full load, both valves 18,19 are closed, whereby the projecting flanges 33 of the valve pistons 23 sealingly abut the first shoulders 35 in the wall 34 of the rotor bore 15, so that no leakage out into the bleed off passageway 20 occurs. The valves 18,19 are maintained closed by means of the oil having approximately the discharge pressure from the compressor being supplied by lines 42 and 40 to the interior of the valves 18,19 through the connections 38 located in the plugs 28. The three-way valves 41 connected by line 40 to said connections 38 are automatically actuated via lines 44, by the pressure in the compressed air tank 52. When the pressure in said tank 52 exceeds a certain pressure, one or both three-way valves 41 are actuated so that oil is released at 46 out of the valve 18,19 and the valve piston 23 then is opened automatically by the tension spring 25 to its fully open position whereby part of the air from the compression space is directed back through the bleed off passageway 20 and end wall passageway 21 to the compressor inlet port 12 without practically any compression work being spent on this bled off air.

The three-way valves 40 are substantially identical and have adjustments that permit setting the valves to operate at different incoming pressures. In one operative example, with the compressed air in the tank 52 and the oil in the oil supply tank 50 both equal to for instance 100 psig, both valves 40 will be set to pass oil from tank 50 to valves 18,19 to hold both valves closed. If at that point there is low demand for compressed air, the compressor will continue to feed compressed air to the air tank 52 until at some elevated point such as at 105 psig the three-way valve 40 connected to valve 18 will shift to shut off oil to valve 18 and to dump the oil in valve 18 thereby permitting the spring 25 to open valve 18. The compressor will now operate at a lower level to compensate for the excess pressure of the compressed air. If the pressure in the compressed air tank 52 continues to build up above a preselected level, the three-way valve 40 connected to valve 19 will shift shutting off incoming oil to valve 19 and dumping the oil in valve 19 so as to open valve 19. The compressor will now operate at still a lower level to balance the demand to the output of the compressor. An increase in the demand for compressed air from the air tank will reduce the pressure in the compressed air tank 52, which will cause the valve 50 connected to valve 19 to shift and admit oil from the oil supply to enter valve 19 and close the valve. The output of the compressor will increase accordingly. However, if the pressure in the air tank is still low, the valve 40 connected to valve 18 will shift and admit oil under pressure from the oil supply to valve 18 to close valve 18 thereby further increasing the output of the compressor.

Due to the fact that the tension spring 25 always opens the valves 18,19 when the compressor stops, it is insured that the valves 18,19 are always open when the compressor is not running and thereby the starting torque is reduced when the compressor is being started up again. Owing to the fact that the valve pistons 23 in closed position are being pressed against the first shoulders 35 in the wall 34 of the rotor barrel, it is insured that at full load no leakage occurs from the compression space out into the bleed off passageway 20. Therefore there is no high requirement as to tolerances with respect to the fit of the valve disk 24 to the rotor bore 15 in the wall 34 because the clearances obtained there do not give any leakage outward, but only a negligible internal leakage within the compression space.

In order to be able to unload the compressor entirely, i.e. down to nearly zero capacity, this valve control arrangement can be completed with some form of throttling at the compressor inlet.

As the valves 18,19 are located so that the center of the valve pistons 23 coincides with the highest located line of the rotor bore 15, a vertical bore accommodating the valve pistons 23 and housings 22 is obtained, which is advantageous from a manufacturing point of view. All machining for the valves 18,19 in the compressor housing 11 can be carried out in one set-up and therefore accurate measures can be obtained with low machining costs. Due to their symmetric forms, also the valve housing 22 and valve piston 23 can be manufactured cheaply and with accurate measures.

The embodiment shows the use of two valves 18,19 located axially one after the other, but also one valve or more than two valves can be applied. In the case of more than two valves, the valves can be operated in sequence as described above or simultaneously.

As should have become apparent from the above description, a substantial simplification with respect to the capacity control of screw compressors compared with conventional systems has been obtained by the present invention. The compressor main housing as well as the inlet housing could hereby be made considerably simpler and be given smaller dimensions and a lower weight, which substantially contributes to the fact that the proposed arrangement would be much cheaper from the manufacturing point of view than the capacity control arrangements used so far in screw compressors. Owing to the fact that the valve pistons 23 operate only in their two end or extreme positions, entirely closed or entirely open, the actuating means is simplified considerably in comparison with conventional systems, resulting in a cheaper and more reliable actuating system.

We claim:

1. In an oil injected screw compressor having a housing with a wall forming two intersecting bores, a pair of meshing rotors in said bores defining a compression space in the housing, and inlet and discharge ports at the ends of said housing, a capacity control comprising:

a valve port in the housing wall between the inlet and discharge ports and communicating with the compression spaced in one of said bores; and a valve formed of a valve housing and a cylindric valve piston slidable therein, which piston has a downwardly facing valve disk sealing against the housing wall, said valve being operably associated with said valve port and movable radially with respect to said one bore between a first position closing said valve port and a second position opening said valve port.

2. The capacity control of claim 1 including a bleed off passageway from said valve port to said inlet port.

3. The capacity control of claim 1 characterized in that the valve is formed of a valve housing and a valve piston slidable therein, said piston sealing against the housing wall.

4. The capacity control of claim 1 characterized in that two or more valves are provided in the housing wall and have one bleed off passageway in common.

5. The capacity control of claim 1 characterized in that the center line of the valve is located in a plane through the center of the rotor perpendicular to the center plane common to both rotors of the compressor.

6. The capacity control of claim 1 characterized in that a shoulder is located in the wall of the valve port against which a flange projecting on the valve disk sealingly abuts when the valve is closed.

7. The capacity control of claim 1 characterized in that a recess is located between the valve disk and the wall of the valve port in order to obtain a rapid connection between the compression space and the bleed off passageway at the beginning of the opening movement of the valve.

8. The capacity control of claim 1 characterized in that a tension spring is provided between the valve housing and the cylindric valve piston for lifting the valve disk and that a connection for pressure oil supply is provided in the valve housing for closing the valve.

9. The capacity control of claim 8 characterized in that the connection for the pressure oil supply communicates with a three-way valve by means of which control of the valve piston either to the fully open or to the fully closed position is effected.

* * * * *